US009034809B2

(12) United States Patent
Najman

(10) Patent No.: US 9,034,809 B2
(45) **Date of Patent: *May 19, 2015**

(54) ANTIWEAR COMPOSITION AND METHOD OF LUBRICATING DRIVELINE DEVICE

(75) Inventor: Morey N. Najman, Midland, MI (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/605,201

(22) Filed: Sep. 6, 2012

(65) Prior Publication Data

US 2012/0329688 A1 Dec. 27, 2012

Related U.S. Application Data

(63) Continuation of application No. 12/920,628, filed as application No. PCT/US2009/036623 on Mar. 10, 2009, now abandoned.

(60) Provisional application No. 61/037,843, filed on Mar. 19, 2008.

(51) Int. Cl.

| | |
|---|---|
| ***C10M 135/36*** | (2006.01) |
| ***C10M 169/04*** | (2006.01) |
| ***C10M 137/10*** | (2006.01) |
| ***C10M 141/10*** | (2006.01) |

(52) U.S. Cl.

CPC ..... *C10M 141/10* (2013.01); *C10M 2203/1006* (2013.01); *C10M 2205/02* (2013.01); *C10M 2205/026* (2013.01); *C10M 2205/0285* (2013.01); *C10M 2205/04* (2013.01); *C10M 2207/282* (2013.01); *C10M 2207/283* (2013.01); *C10M 2207/289* (2013.01); *C10M 2207/34* (2013.01); *C10M 2209/084* (2013.01); *C10M 2215/08* (2013.01); *C10M 2215/082* (2013.01); *C10M 2215/086* (2013.01); *C10M 2219/022* (2013.01); *C10M 2219/08* (2013.01); *C10M 2219/106* (2013.01); *C10M 2223/042* (2013.01); *C10M 2223/043* (2013.01); *C10M 2223/045* (2013.01); *C10N 2230/06* (2013.01); *C10N 2230/42* (2013.01); *C10N 2240/04* (2013.01); *C10N 2240/042* (2013.01); *C10N 2240/044* (2013.01); *C10N 2260/14* (2013.01)

(58) Field of Classification Search

CPC ..... C10M 2219/04; C10M 2223/04; C10M 2207/129

USPC ..... 508/272, 423, 425, 306

See application file for complete search history.

(56) References Cited

U.S. PATENT DOCUMENTS

| | | | | |
|---|---|---|---|---|
| 2,365,291 | A | 12/1944 | Prutton et al. | |
| 2,443,578 | A | 6/1948 | Fuller et al. | |
| 3,197,405 | A * | 7/1965 | Le Suer | 508/349 |
| 4,237,022 | A | 12/1980 | Barrer | |
| 4,326,972 | A | 4/1982 | Chamberlin | |
| 4,640,787 | A | 2/1987 | Schuettenberg | |
| 4,952,328 | A | 8/1990 | Davis et al. | |
| 5,338,470 | A | 8/1994 | Hiebert et al. | |
| 5,387,351 | A | 2/1995 | Kumar et al. | |
| 6,573,223 | B1 | 6/2003 | Vinci et al. | |
| 2005/0198894 | A1 | 9/2005 | Migdal et al. | |
| 2006/0079413 | A1 * | 4/2006 | Kocsis et al. | 508/287 |
| 2006/0183647 | A1 * | 8/2006 | Kocsis et al. | 508/287 |
| 2006/0276352 | A1 * | 12/2006 | Vinci | 508/272 |
| 2010/0048437 | A1 | 2/2010 | Brown et al. | |

FOREIGN PATENT DOCUMENTS

| | | |
|---|---|---|
| GB | 2105743 | 3/1983 |
| WO | 2006044411 | 4/2006 |
| WO | 2008067259 | 6/2008 |
| WO | 2008094759 | 8/2008 |
| WO | 2008147700 | 12/2008 |

OTHER PUBLICATIONS

Corresponding PCT International Publication No. 2010/141003 A1 and Search Report published Dec. 9, 2010.

* cited by examiner

*Primary Examiner* — Vishal Vasisth

(74) *Attorney, Agent, or Firm* — Teresan W. Gilbert, Esq.; David M. Shold, Esq.

(57) ABSTRACT

The present invention relates to a method of driveline device by supplying to the driveline device a lubricating composition containing an oil of lubricating viscosity and an antiwear package, wherein the antiwear package includes: (a) derivatives of a carboxylic acid (typically a hydroxycarboxylic acid); and (b) a phosphorus compound. The invention further provides lubricating compositions containing an oil of lubricating viscosity and an antiwear package, wherein the antiwear package includes (a) derivatives of a carboxylic acid (typically a hydroxycarboxylic acid); and (b) an amine or metal salt of a phosphorus compound that is either (i) a hydroxy-substituted di-ester of (thio)phosphoric acid, or (ii) a phosphorylated hydroxy-substituted di- or tri-ester of (thio) phosphoric acid.

10 Claims, No Drawings

ANTIWEAR COMPOSITION AND METHOD OF LUBRICATING DRIVELINE DEVICE

This application is a CON of Ser. No. 12/920,628, filed Mar. 23, 2011, now abandoned, which is a 371 of PCT/US2009/036623, filed Mar. 10, 2009, which claims benefit of 61/037,843, filed Mar. 19, 2008.

FIELD OF INVENTION

The invention provides a lubricating composition containing an antiwear package. The invention further relates to a method of lubricating a mechanical device by lubricating the device with the lubricating composition.

BACKGROUND OF THE INVENTION

Lubricants for driveline power transmitting devices (such as gears or transmissions), especially axle fluids, automatic transmission fluids (ATFs), and manual transmission fluids (MTFs)), present highly challenging technological problems and solutions for satisfying the multiple and often conflicting lubricating requirements, whilst providing durability and cleanliness. One of the important parameters influencing durability is the effectiveness of phosphorus antiwear or extreme pressure additives at providing devices with appropriate protection under various conditions of load and speed. However, many of the phosphorus antiwear or extreme pressure additives contain sulphur. Due to increasing environmental concerns, the presence of sulphur in antiwear or extreme pressure additives is becoming less desirable. In addition, many lubricating compositions containing antiwear or extreme pressure additives evolve volatile sulphur species resulting in an odour and potential detriment to health and the environment.

A lubricating composition having the correct balance of phosphorus antiwear or extreme pressure additives provides driveline power transmitting devices with prolonged life and efficiency with controlled deposit formation and oxidation stability. However, many of the antiwear or extreme pressure additives employed have limited oxidative stability, form deposits, or increase corrosion. In addition, many phosphorus antiwear or extreme pressure additives typically contain sulphur, which results in an odorous lubricating composition containing the phosphorus antiwear or extreme pressure additives. A number of references disclosing antiwear chemistry are discussed below.

U.S. Pat. No. 5,338,470 discloses alkylated citric acid derivatives obtained as a reaction product of citric acid and an alkyl alcohol or amine. The alkylated citric acid derivative is effective as an antiwear agent and friction modifier.

U.S. Pat. No. 4,237,022 discloses tartrimides useful as additives in lubricants and fuels for effective reduction in squeal and friction as well as improvement in fuel economy.

U.S. Pat. No. 4,952,328 discloses lubricating oil compositions for internal combustion engines, comprising (A) oil of lubricating viscosity, (B) a carboxylic derivative produced by reacting a succinic acylating agent with certain amines, and (C) a basic alkali metal salt of sulphonic or carboxylic acid.

U.S. Pat. No. 4,326,972 discloses lubricant compositions for improving fuel economy of internal combustion engines. The composition includes a specific sulphurised composition (based on an ester of a carboxylic acid) and a basic alkali metal sulphonate.

U.S. Patent Application 60/862,534 (PCT/US07/082,057) discloses malonate esters suitable as antiwear agents.

International Publication WO 2005/087904 discloses lubricants containing hydroxy carboxylic acid and hydroxy polycarboxylic acid esters in combination with phosphorus-containing additives. The phosphorus-containing additives include zinc dihydrocarbyldithiophosphates and/or neutral phosphorus compounds, such as trilauryl phosphate or triphenylphosphorothionate. The lubricants are useful in engine lubricants.

International Publication WO 2006/044411 discloses a low-sulphur, low-phosphorus, low-ash lubricant composition containing a tartrate ester, or amide having 1 to 150 carbon atoms per ester or amide group. The lubricant composition is suitable for lubricating an internal combustion engine.

SUMMARY OF THE INVENTION

The inventors of the this invention have discovered that a lubricating composition and method as disclosed herein is capable of providing acceptable levels of at least one of (i) sulphur (typically reducing or preventing emissions from waste oil), (ii) fuel economy/efficiency (typically improving fuel economy/efficiency), (iii) oxidation control (typically reducing or preventing oxidation), (iv) friction performance, (v) wear and/or extreme pressure performance (typically reducing or preventing), and (vi) deposit control.

In one embodiment the invention provides a lubricating composition comprising an oil of lubricating viscosity and an antiwear package, wherein the antiwear package comprises:

(a) a derivative of a hydroxycarboxylic acid; and (b) an amine or metal salt of a phosphorus compound, wherein the metal salt contains a mono-valent metal (such as sodium, lithium or potassium).

In one embodiment the invention provides a lubricating composition comprising an oil of lubricating viscosity and an antiwear package, wherein the antiwear package comprises:

(a) a derivative of a hydroxycarboxylic acid; and (b) an amine salt of a phosphorus compound (may also be referred to as an ashless salt of a phosphorus compound).

In one embodiment the invention provides a lubricating composition comprising an oil of lubricating viscosity and an antiwear package, wherein the antiwear package comprises:

(a) a derivative of a hydroxycarboxylic acid; and (b) an amine or metal salt of a phosphorus compound that is either (i) a hydroxy-substituted di-ester of (thio)phosphoric acid, or (ii) a phosphorylated hydroxy-substituted di- or tri-ester of (thio)phosphoric acid.

In one embodiment the invention provides a lubricating composition comprising an oil of lubricating viscosity and an antiwear package, wherein the antiwear package comprises:

(a) an antiwear agent which may be represented by a compound of Formula (1a) and/or (1b):

Formula (1a)

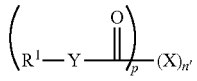

Formula (1b)

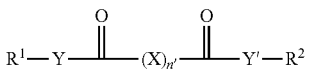

wherein n' is 0 to 10 for Formula (1b), and 1 to 10 for Formula (1a);

p is 1 to 5;

Y and Y' are independently —O—, >NH, >$NR^3$, or an imide group formed by taking together both Y and Y' groups in (1b) or two Y groups in (1a) and forming a $R^1$—N<group between two >C═O groups;

X is independently —$CH_2$—, >$CHR^4$ or >$CR^4R^5$, >$CHOR^6$, or >$C(CO_2R^6)_2$, —$CH_3$, —$CH_2R^4$ or $CHR^4R^5$, —$CH_2OR^6$, or —$CH(CO_2R^6)_2$, ≡C—$R^6$ (where = equals three valences, and may only apply to Formula (1a)) or mixtures thereof to fulfill the valence of Formula (1a) and/or (1b) (typically the compound of Formula (1a) or (1b) has at least one X that is hydroxyl-containing (i.e., >$CHOR^6$, wherein $R^6$ is hydrogen));

$R^1$ and $R^2$ are independently hydrocarbyl groups, typically containing 1 to 150 carbon atoms;

$R^3$ is a hydrocarbyl group;

$R^4$ and $R^5$ are independently keto-containing groups (such as acyl groups), ester groups or hydrocarbyl groups; and $R^6$ is independently hydrogen or a hydrocarbyl group, typically containing 1 to 150 carbon atoms; and (b) an amine or metal salt of a phosphorus compound that may be either (i) a hydroxy-substituted di-ester of (thio) phosphoric acid, or (ii) a phosphorylated hydroxy-substituted di- or tri-ester of (thio)phosphoric acid.

When X is hydroxyl-containing, the compound Formula (1a) and/or (1b) may be derived from hydroxycarboxylic acids such as tartaric acid, citric acid, or mixtures thereof.

When X is not hydroxyl-containing, the compound Formula (1a) and/or (1b) may be derived from malonic acid, oxalic acid, chlorophenyl malonic acid, or mixtures thereof.

In one embodiment the invention provides a method for lubricating a driveline device comprising supplying to the driveline device a lubricating composition comprising an oil of lubricating viscosity and an antiwear package, wherein the antiwear package comprises a compound of Formula (1a) and/or (1b) (as defined above) and a phosphorus compound (for example, a phosphorus acid or an ester thereof or a salt thereof or the salt of an ester thereof). Typically the phosphorus compound is oil-soluble.

In one embodiment the invention provides a lubricating composition comprising an oil of lubricating viscosity and an antiwear package, wherein the antiwear package comprises:

(a) a derivative of a hydroxycarboxylic acid, wherein the hydroxycarboxylic acid is tartaric acid; and (b) an amine or metal salt of a phosphorus compound that may be (i) a hydroxy-substituted di-ester of (thio)phosphoric acid, or (ii) a phosphorylated hydroxy-substituted di- or tri-ester of (thio)phosphoric acid.

In one embodiment the derivatives of hydroxycarboxylic acid include imide, di-esters, di-amides, ester-amide derivatives of tartaric acid.

In different embodiments the lubricating compositions disclosed herein contain 0 ppm to 500 ppm, or 5 ppm to 300 ppm, or 20 ppm to 250 ppm of molybdenum.

In one embodiment the invention provides a method for lubricating a mechanical device (typically a driveline device) comprising supplying to the mechanical a device a lubricating composition as disclosed herein.

In one embodiment the invention provides a method for lubricating a driveline device comprising supplying to the mechanical a device a lubricating composition comprising an oil of lubricating viscosity and an antiwear package, wherein the antiwear package comprises:

a. a derivative of a hydroxycarboxylic acid, typically the hydroxycarboxylic acid is tartaric acid; and b. a phosphorus compound (typically, an amine or metal salt of a phosphorus compound that may be either (i) a hydroxy-substituted di-ester of (thio)phosphoric acid, or (ii) a phosphorylated hydroxy-substituted di- or tri-ester of (thio)phosphoric acid).

The lubricating compositions disclosed herein may have a sulphur-content of greater than 0.3 wt %, or 0.4 wt % to 5 wt %, or 0.5 wt % to 3 wt %, 0.8 wt % to 2.5 wt %, or 1 wt % to 2 wt % of the lubricating composition.

In one embodiment the invention provides for the use of a lubricating composition as disclosed herein for providing acceptable levels of at least one of (i) phosphorus emissions, (ii) sulphur emissions, (iii) fuel economy/efficiency, (iv) oxidation control, (v) friction performance, (vi) wear and/or extreme pressure performance (typically reducing or preventing), and (vii) deposit control.

DETAILED DESCRIPTION OF THE INVENTION

The present invention provides a lubricating composition and a method for lubricating a mechanical device as disclosed above. Typically the mechanical device is a driveline device (including a gear or transmission).

Antiwear Package

The antiwear package includes two antiwear agents as disclosed above.

The antiwear package typically includes (i) a derivative of a hydroxycarboxylic acid, and (ii) a phosphorus compound (typically an ashless phosphorus compound). The phosphorus compound may include an amine or metal salt of a phosphorus compound that may be either (i) a hydroxy-substituted di-ester of (thio)phosphoric acid, or (ii) a phosphorylated hydroxy-substituted di- or tri-ester of (thio)phosphoric acid.

The antiwear package may be present at 0.01 wt % to 10 wt %, or 0.05 wt % to 10 wt %, or 0.05 wt % to 5 wt % of the lubricating composition.

The derivative of a hydroxycarboxylic acid (or the antiwear agent represented by a compound of Formula (1a) and/or (1b)) may be present at 0.005 wt % to 10 wt %, or 0.025 to 5 wt %, or 0.25 to 2.5 wt % of the lubricating composition.

The phosphorus compound may be present at 0.005 wt % to 10 wt %, or 0.025 to 5 wt %, or 0.05 to 2.5 wt % of the lubricating composition.

Derivative of a Hydroxycarboxylic Acid

In one embodiment one antiwear agent derived from Formula (1a) and/or (1b) includes a derivative of a hydroxycarboxylic acid. The derivative of a hydroxycarboxylic acid, typically a tartrate, may also function as rust and corrosion inhibitors, friction modifiers, antiwear agents and demulsifiers. In one embodiment the derivative of a hydroxycarboxylic acid may also have friction modifying properties.

In one embodiment the derivative of a hydroxycarboxylic acid may be ashless (i.e., do not contain metal in amounts greater than those associated with contaminant amounts).

Derivatives of the hydroxycarboxylic acid include imides, di-esters, di-amides, di-imides (applicable for tetra-acids and higher), ester-amides, ester-imides (applicable for tri-acids and higher, such as citric acid), imide-amides (applicable for tri-acids and higher, such as citric acid). In one embodiment the antiwear agent includes imides, di-esters, di-amides, or ester-amides.

In one embodiment the antiwear agent may be derived from at least one of a hydroxy-carboxylic acid di-ester, a hydroxy-carboxylic acid di-amide, a hydroxy-carboxylic acid di-imide, a hydroxy-carboxylic acid ester-amide, a hydroxy-carboxylic acid ester-imide, and a hydroxy-carboxylic acid imide-amide. In one embodiment the antiwear agent may be derived from at least one of the group consisting of a hydroxy-carboxylic acid di-ester, a hydroxy-carboxylic acid di-amide, and a hydroxy-carboxylic acid ester-amide.

Examples of a suitable a hydroxycarboxylic acid include citric acid, tartaric acid, malic acid (or hydroxy-succinic acid), lactic acid, oxalic acid, glycolic acid, hydroxy-propionic acid, hydroxyglutaric acid, or mixtures thereof. In one embodiment the antiwear agent may be derived from tartaric acid, citric acid, hydroxy-succinic acid, dihydroxy mono-acids, mono-hydroxy diacids, or mixtures thereof. In one embodiment the antiwear agent includes a compound derived from tartaric acid.

US Patent Application 2005/198894 discloses suitable hydroxycarboxylic acid compounds, and methods of preparing the same.

Canadian Patent 1183125; US Patent Publication numbers 2006/0183647 and US-2006-0079413; U.S. Patent Application No. 60/867,402; and British Patent 2 105 743 A, all disclose examples of suitable tartaric acid derivatives.

A detailed description of methods for preparing suitable tartrimides (by reacting tartaric acid with a primary amine) is disclosed in U.S. Pat. No. 4,237,022.

In one embodiment the antiwear agent includes imide, di-esters, di-amides, ester-amide derivatives of tartaric acid.

In one embodiment the antiwear agent may be represented by a compound of Formula (1a) and/or (1b) as defined above: wherein n' is 0 to 10, 0 to 6, or 0 to 4 for Formula (1b), and for Formula (1a) 1 to 4, or 1 to 2;

p is 1 to 5, or 1 to 2, or 1;

Y and Y' are independently —O—, >NH, >$NR^3$, or an imide group formed by taking together both Y and Y' groups and forming a $R^1$—N<group between two >C═O groups;

X is independently —$CH_2$—, >$CHR^4$ or >$CR^4R^5$, >$CHOR^6$, or >$C(CO_2R^6)_2$, —$CH_3$, —$CH_2R^4$ or $CHR^4R^5$, —$CH_2OR^6$, or —$CH(CO_2R^6)_2$, ≡C—$R^6$ (where ≡ equals three valences, and may only apply to Formula (1a)) or mixtures thereof to fulfill the valence of Formula (1a) and/or (1b) (typically the compound of Formula (1a) or (1b) has at least one X that is hydroxyl-containing (i.e., >$CHOR^6$, wherein $R^6$ is hydrogen));

$R^1$ and $R^2$ are independently hydrocarbyl groups, typically containing 1 to 150, 4 to 30, or 6 to 20, or 10 to 20, or 11 to 18 carbon atoms;

$R^3$ is a hydrocarbyl group;

$R^4$ and $R^5$ are independently keto-containing groups (such as acyl groups), ester groups or hydrocarbyl groups; and $R^6$ is independently hydrogen or a hydrocarbyl group, typically containing 1 to 150, or 4 to 30 carbon atoms.

In one embodiment the di-esters, di-amides, di-imides (applicable for tetra-acids and higher), ester-amide, ester-imide (applicable for tri-acids and higher, such as citric acid), imide-amide (applicable for tri-acids and higher, such as citric acid) compounds may be derived from a compound of Formula (1a) and/or (1b). In one embodiment the di-esters, di-amides, ester-amide, compounds may be derived from a compound of Formula (1a) and/or (1b).

In one embodiment the compound of Formula (1b) contains an imide group. The imide group is typically formed by taking together the Y and Y' groups and forming a $R^1$—N<group between two >C═O groups.

In one embodiment the compound of Formula (1a) and/or (1b) has n, X, and $R^1$, $R^2$ and $R^6$ defined as follows: n is 1 to 2, X is >$CHOR^6$; and $R^1$, and $R^2$ are independently hydrocarbyl groups containing 4 to 30 carbon atoms, and $R^6$ is independently hydrogen or a hydrocarbyl group containing 4 to 30 carbon atoms.

In one embodiment Y and Y' are both —O—.

In one embodiment the compound of Formula (1a) and/or (1b) has n, X, Y, Y' and $R^1$, $R^2$ and $R^6$ defined as follows: n is 1 to 2, X is >$CHOR^6$; Y and Y' are both —O—, and $R^1$, and $R^2$ are independently hydrocarbyl groups containing 4 to 30 carbon atoms, and $R^6$ is independently hydrogen or a hydrocarbyl group containing 4 to 30 carbon atoms.

The di-esters, di-amides, di-imides (applicable for tetra-acids and higher), ester-amide, ester-imide (applicable for tri-acids and higher, such as citric acid), imide-amide (applicable for tri-acids and higher, such as citric acid) compounds of Formula (1a) and/or (1b) may be prepared by reacting a dicarboxylic acid (such as tartaric acid), with an amine or alcohol, optionally in the presence of a known esterification catalyst. The amine or alcohol typically has sufficient carbon atoms to fulfill the requirements of $R^1$ and/or $R^2$ as defined in Formula (1a) and/or (1b).

In one embodiment $R^1$ and $R^2$ may be independently linear or branched hydrocarbyl groups. In one embodiment the hydrocarbyl groups may be branched. In one embodiment the hydrocarbyl groups may be linear. The $R^1$ and $R^2$ may be incorporated into Formula (1a) and/or (1b) by either an amine or an alcohol. The alcohol includes both monohydric alcohol and polyhydric alcohol.

In one embodiment the antiwear agent may be derived from a compound of Formula (1b).

Examples of a suitable branched alcohol include 2-ethylhexanol, isotridecanol, Guerbet alcohols, or mixtures thereof.

Examples of a monohydric alcohol include methanol, ethanol, propanol, butanol, pentanol, hexanol, heptanol, octanol, nonanol, decanol, undecanol, dodecanol, tridecanol, tetradecanol, pentadecanol, hexadecanol, heptadecanol, octadecanol, nonadecanol, eicosanol, or mixtures thereof. In one embodiment the monohydric alcohol contains 5 to 20 carbon atoms.

The alcohol includes either a monohydric alcohol or a polyhydric alcohol. Examples of a suitable polyhydric alcohol include ethylene glycol, propylene glycol, 1,3-butylene glycol, 2,3-butylene glycol, 1,5-pentane diol, 1,6-hexane diol, glycerol, sorbitol, pentaerythritol, trimethylolpropane, starch, glucose, sucrose, methylglucoside, or mixtures thereof. In one embodiment the polyhydric alcohol may be used in a mixture along with a monohydric alcohol. Typically, in such a combination the monohydric alcohol constitutes at least 60 mole percent, or at least 90 mole percent of the mixture.

In one embodiment the antiwear agent may be derived from tartaric acid. The tartaric acid used for preparing the tartrates of the invention may be commercially available (for instance obtained from Sargent Welch), and it is likely to exist in one or more isomeric forms such as d-tartaric acid, l-tartaric acid, d,l-tartaric acid (racemic mixture) or mesotartaric acid, often depending on the source (natural) or method of synthesis (e.g. from maleic acid). These derivatives may also be prepared from functional equivalents to the diacid readily apparent to those skilled in the art, such as esters, acid chlorides, or anhydrides.

When the compound of Formula (1a) and/or (1b) is derived from tartaric acid, resultant tartrates may be solid, semi-solid, or oil depending on the particular alcohol used in preparing the tartrate. For use as additives in oleaginous compositions including lubricating and fuel compositions the tartrates are advantageously soluble and/or stably dispersible in such oleaginous compositions. For example, compositions intended for use in oils are typically oil-soluble and/or stably dispersible in an oil in which they are to be used. The term "oil-soluble" as used in this specification and appended claims does not necessarily mean that all the compositions in question are miscible or soluble in all proportions in all oils. Rather, it is intended to mean that the composition is soluble in an oil (e.g., mineral oil, or synthetic oil) in which it is intended to function to an extent which permits the solution to exhibit one or more of the desired properties. Similarly, it is not necessary that such "solutions" be true solutions in the strict physical or chemical sense. They may instead be microemulsions or colloidal dispersions which, for the purpose of this invention, exhibit properties sufficiently close to those of true solutions to be, for practical purposes, interchangeable with them within the context of this invention.

Amine or Metal Salt of a Phosphorus Compound

As used herein the term "(thio)phosphoric" means either a sulphur-containing phosphoric acid or a sulphur-free phosphoric acid.

In one embodiment an amine or metal salt of a phosphorus compound may be either (i) a hydroxy-substituted di-ester of (thio)phosphoric acid, or (ii) a phosphorylated hydroxy-substituted di- or tri-ester of (thio)phosphoric acid.

In one embodiment the amine or metal salt of a phosphorus compound is sulphur-free.

The amine or metal salt of a sulphur-free phosphorus compound may be represented Formula (2):

Formula (2)

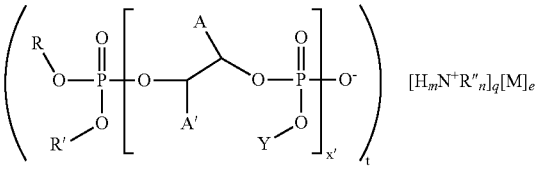

$[H_mN^+R''_n]_q[M]_e$ wherein

A and A' are independently H, or a hydrocarbyl group containing 1 to 30 carbon atoms;

each R and R" group are independently a hydrocarbyl group;

each R' is independently R, H, or a hydroxyalkyl group;

Y is independently R', or a group represented by RO(R'O)P(O)—CH(A')CH(A)- (such as RO(R'O)P(O)—$CH_2CH(CH_3)$—);

x' ranges from 0 to 1 (in one embodiment when x'=0, R' is a hydroxyalkyl group); and m and n are both positive non-zero integers, with the proviso that the sum of (m+n) is equal to 4;

M is a metal ion;

t is an integer varying from 1 to 4 (or 1 to 2); and q and e are fractions, whose total provides complete valence to satisfy t, with the proviso that q is in the range of 0.1 to 1.5 (or 0.1 to 1), and e is in the range of 0 to 0.9.

The amine salt of a sulphur-free phosphorus compound may be represented by Formula (2a):

Formula (2a)

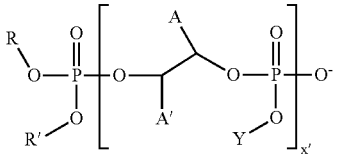

$H_mN^+R''_n$ wherein

A and A' are independently H, or a hydrocarbyl group containing 1 to 30 carbon atoms;

each R and R" group are independently a hydrocarbyl group;

each R' is independently R, H, or a hydroxyalkyl group;

Y is independently R', or a group represented by RO(R'O)P(O)—CH(A')CH(A)- (such as RO(R'O)P(O)—$CH_2CH(CH_3)$—);

x' ranges from 0 to 1 (in one embodiment when x'=0, R' is a hydroxyalkyl group);

m and n are both positive non-zero integers, with the proviso that the sum of (m+n) is equal to 4.

In one embodiment the compound represented by Formula (2) or Formula (2a) has x' equal to 1.

In one embodiment the compound represented by Formula (2) or Formula (2a) has x' is equal to 0.

In one embodiment the compound represented by Formula (2) or Formula (2a) has m equal to 2; and n equal to 2.

In one embodiment the compound represented by Formula (2) or Formula (2a) has m equal to 3; and n equal to 1.

In one embodiment A and A' independently contain 1 to 10, or 2 to 6, or 2 to 4 carbon atoms.

In one embodiment R, R' and R" all independently contain 1 to 30, or 1 to 20, or 4 to 20 carbon atoms. In one embodiment up to half of the R' groups may be hydrogen.

In one embodiment R" contains 8 to 26, or 10 to 20, or 13 to 19 carbon atoms.

The compound of Formula (2) or Formula (2a) includes amine salts of a primary amine, a secondary amine, a tertiary amine, or mixtures thereof. In one embodiment the primary amine includes a tertiary-aliphatic primary amine.

Examples of suitable primary amines include ethylamine, propylamine, butylamine, 2-ethylhexylamine, octylamine, and do decylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine, bis-2-ethylhexylamine, N-methyl-1-amino-cyclohexane, Armeen® 2C and ethylamylamine. The secondary amines may be cyclic amines such as piperidine, piperazine and morpholine.

Examples of tertiary amines include tri-n-butylamine, tri-n-octylamine, tri-decylamine, tri-laurylamine, tri-hexadecylamine, and dimethyloleylamine (Armeen® DMOD).

In one embodiment the amines may be in the form of a mixture. Examples of suitable mixtures of amines include (i) an amine with 11 to 14 carbon atoms on tertiary alkyl primary groups, (ii) an amine with 14 to 18 carbon atoms on tertiary alkyl primary groups, or (iii) an amine with 18 to 22 carbon atoms on tertiary alkyl primary groups. Other examples of tertiary alkyl primary amines include tert-butylamine, tert-hexylamine, tert-octylamine (such as 1,1-dimethylhexylamine), tert-decylamine (such as 1,1-dimethyloctylamine), tertdodecylamine, tert-tetradecylamine, tert-hexadecylamine, tert-octadecylamine, tert-tetracosanylamine, and tert-octacosanylamine.

In one embodiment a useful mixture of amines includes "Primene® 81R" or "Primene® JMT." Primene® 81R and Primene® JMT (both produced and sold by Rohm & Haas) may be mixtures of C11 to C14 tertiary alkyl primary amines and C18 to C22 tertiary alkyl primary amines respectively.

In one embodiment the metal ion of Formula (2) may be a mono- or di-valent metal, or mixtures thereof. In one embodiment the metal ion may be divalent.

In one embodiment the metal of the metal ion includes lithium, sodium, potassium, calcium, magnesium, barium, copper, nickel, tin or zinc.

In one embodiment the metal of the metal ion includes lithium, sodium, calcium, magnesium, or zinc. In one embodiment the metal of the metal ion may be zinc.

In one embodiment t is equal to 1, when the compound of Formula (2) is an amine salt or a metal salt of a monovalent metal.

In one embodiment t is equal to 2, when the compound of Formula (2) is a metal salt of a divalent metal.

In one embodiment q is in the range of 0.5 to 1; and e is in the range of 0 to 0.5.

In one embodiment the compound of Formula (2) is free of a metal ion (e is equal to zero; and q is equal to one).

In one embodiment t is equal to 1, e is equal to 0, and q is equal to 1.

Processes to Prepare Compound of Formula (2) and Formula (2a)

In one embodiment the sulphur-free amine salt of a phosphorus compound obtained/obtainable by a process comprising: reacting an amine with either (i) a hydroxy-substituted di-ester of phosphoric acid, or (ii) a phosphorylated hydroxy-substituted di- or tri-ester of phosphoric acid.

In one embodiment the salt of a hydroxy-substituted di-ester of phosphoric acid may be prepared by a process comprising:

(i) reacting a phosphating agent (such as $P_2O_5$, $P_4O_{10}$, or equivalents thereof) with an alcohol, to form a mono- and/or di-phosphate ester;

(ii) reacting the phosphate ester with an alkylene oxide, to form a hydroxy-substituted di-ester of phosphoric acid; and (iii) salting the hydroxy-substituted di-ester of phosphoric acid is reacted with an amine and/or metal.

In one embodiment the hydroxy-substituted di-ester of phosphoric acid of (ii) may be further reacted at least once more, by repeating step (i) above, with a phosphating agent (typically forming a phosphorylated hydroxy-substituted di- or tri-ester of phosphoric acid), before salting with an amine and/or metal (as in step (iii) above).

In different embodiments, steps (i) and (ii) may be repeated at least once more, optionally followed by step (i) before salting with an amine and/or metal (as in step (iii) above). For example the salts may be prepared by a process comprising performing the steps (i), (ii), and (iii); or (i), (ii), (i), and (iii); or (i), (ii), (i), (ii), and (iii); (i), (ii), (i), (ii), (i), and (iii), or (i), (ii), (i), (ii), (i), (ii), and (iii), or (i), (ii), (i), (ii), (i), (ii), (i) and (iii), or (i), (ii), (i), (ii), (i), (ii), (i), (ii) and (iii), as defined above.

In different embodiments the reaction product yields 1 wt % to 99 wt %, or 20 wt % to 80 wt %, or 35 wt % to 75 wt %, of the sulphur-free amine salt of a phosphorus compound of the invention.

In different embodiments, the mole ratio in step (i) of the mono-phosphate to di-phosphate includes ranges of 1:10 to 10:1, or 1:5 to 5:1, or 1:2 to 2:1, or 1:1.

In different embodiments, the mole ratio (based on the amount of phosphorus) in step (i) of alkylene oxide to the mono- and/or di-phosphate ester of step (i) includes ranges of 0.6:1 to 1.5:1, or 0.8:1 to 1.2:1.

In one embodiment alkylene oxide includes ethylene oxide, propylene oxide or butylene oxide; and the mole ratio of alkylene oxide to hydroxy-substituted di-ester of phosphoric acid in step (ii) includes 1:1.

In one embodiment alkylene oxide includes $C_5$ and higher alkylene oxide; and the mole ratio of alkylene oxide to the hydroxy-substituted di-ester of phosphoric acid in step (ii) includes broader ranges because the alkylene oxides are less volatile under reaction conditions.

The process described above in steps (i) to (iii), in different embodiments may be carried out at a reaction temperature in a range of 30° C. to 140° C., or 40° C. to 110° C., or 45° C. to 90° C.

The process may be carried out at reduced pressure, atmospheric pressure or above atmospheric pressure. In one embodiment the process may be carried out at atmospheric pressure or above atmospheric pressure.

In one embodiment the process may be carried out in an inert atmosphere. Examples of a suitable inert atmosphere include nitrogen, argon, or mixtures thereof.

In different embodiments, the alkylene oxide contains 1 to 10, or 2 to 6, or 2 to 4 carbon atoms. In one embodiment the alkylene oxide include ethylene oxide, propylene oxide, butylene oxide, or mixtures thereof. In one embodiment the alkylene oxide includes propylene oxide.

In different embodiments, the alcohol contains 1 to 30, or 4 to 24, or 8 to 18 carbon atoms.

The alcohol may be linear or branched.

The alcohol may be saturated or unsaturated.

Examples of a suitable alcohol include hexanol, heptanol, octanol, nonanol, dodecanol, dodecanol, tridecanol, tetradecanol, pentadecanol, hexadecanol, heptadecanol, octadecanol, octadecenol (oleyl alcohol), nonadecanol, eicosyl-alcohol, or mixtures thereof. Examples of a suitable alcohol include for example, 4-methyl-2-pentanol, 2-ethylhexanol, isooctanol, or mixtures thereof.

Examples of commercially available alcohols include Alcohol® 7911, Oxo Alcohol® 7900 and Oxo Alcohol® 1100 of Monsanto; Alphanol® 79 of ICI; Nafol® 1620, Alfol® 610 and Alfol® 810 of Condea (now Sasol); Epal® 610 and Epal® 810 of Ethyl Corporation; Linevol® 79, Linevol® 911 and Dobanol® 25 L of Shell AG; Lial® 125 of Condea Augusta, Milan; Dehydad® and Lorol® of Henkel KGaA (now Cognis) as well as Linopol® 7-11 and Acropol® 91 of Ugine Kuhlmann.

Useful amines include amine salts of a primary amine, a secondary amine, a tertiary amine, or mixtures thereof. A more detailed description of useful amines is defined above.

Amine Salts of Phosphoric Acid

Preparative Examples

Preparative Example 1

Step A: Phosphorus pentoxide (219 g, about 1.54 mol) is added slowly over a period of about 1.5 hours to a flask containing isooctyl alcohol (about 602 g, about 4.63 mol) whilst stirring at about 60° C. to about 70° C. in a nitrogen atmosphere. The mixture is then heated to about 90° C. and held there for about 5 hours. The product is cooled. Analysis of the product indicates a phosphorus content of about 11.6 wt %.

Step B: At temperature of about 50° C., a flask containing the product of Step A (about 760 g, about 2.71 mol based on equivalent weight of 280 g/mol) stirring at (15-40° C.) mixed with a stoichiometric amount of propylene oxide (about 157.7 g, about 2.71 mol) dropwise via an addition funnel. The propylene oxide is added over a period of about 1.5 hours, to form a mixture. The mixture is then heated to 70° C. and held for about 2 hours. The product is cooled. The product of Step B has a phosphorus content of about 9.6 wt %.

Step C: The product of Step B (about 881.5 g, 2.73 mol P based on % P=9.6) is heated to 50° C. under nitrogen and phosphorus pentoxide (129 g, 0.91 mol) is added in four equal portions over about one hour. During the addition the temperature is maintained between the range of about 55° C. to about 70° C., whilst vigorously stirring to provide a product that is a homogeneous solid. The temperature is raised to about 80° C.; and held for about 3 hours, to form a product. Upon cooling the product contains 13.7 wt % of phosphorus Step D: The product of Step C (about 706.7 g, about 2.24 mol) is heated to about 45° C. in a nitrogen atmosphere in a flask. Bis-(2-ethylhexyl)amine (about 596 g, about 2.47 mol) is added dropwise via an addition funnel over a period of about 2 hours whilst controlling the temperature to be about 55° C. to about 60° C. The flask is then heated to about 75° C. and held there for about 2 hours. Upon cooling the product of Step D is light orange and has a phosphorus content of 7.7 wt %.

Preparative Example 2

Preparative Example 2 is prepared employing a similar procedure as Step A and Step B of Preparative Example 1. However, for Step A, a stoichiometric amount of propylene oxide (209 g, 3.60 mol) is added to isooctyl phosphate acid (about 952 g, about 3.43 mol). The mixture is then heated to about 75° C. for 4 hours. The resultant product of Step A has a phosphorus content of about 9.65 wt %. For Step B, the product of Step A (about 208 g, about 0.374 mol) is heated in the flask and bis-(2-ethylhexyl)amine (about 97.5 g, about 0.404 mol) is added dropwise via an addition funnel over a period of about 40 minutes. The reaction temperature is then raised to about 75° C. and held for about 5 hours. The resultant product has a phosphorus content of about 6.6 wt %.

Preparative Example 3

Preparative Example 3 is prepared in a similar procedure as Preparative Example 1. However, step A of Preparative Example 3 reacts phosphorus pentoxide (about 189 g, about 1.33 mol), methylamyl alcohol (about 408 g, about 4 mol). The phosphorus pentoxide is added over a period of about 75 minutes and at a temperature of about 60° C. The product is then heated to about 70° C. and held for about 1.5 hours. The resultant product has a phosphorus content of about 13.7 wt %. Step B is carried out by reacting the product of Step A (171.7 g, 0.719 mol based on equivalent weight of 240 g/mol), with about 1.1 equivalents of propylene oxide (about 46.0 g, about 0.791 mol). The resultant product has a phosphorus content of about 10.96 wt %. Step C is carried out by heating the product of Step B (about 200 g, about 0.71 mol) at about 60° C. under a nitrogen atmosphere and reacting with phosphorus pentoxide (about 33 g, about 0.23 mol). The reaction exotherm reaches about 87° C. Upon cooling to about 65° C., the flask is held at this temperature for about 1.5 hours. The flask is then cooled to about 40° C. followed by the dropwise addition over a period of about 1.5 hours of bis-(2-ethylhexyl) amine (about 200 g, about 0.83 mol). The flask is then heated to about 75° C. and held for about 2 hours. The product has a phosphorus content of about 8.6 wt %, and a nitrogen content of about 2.8 wt %.

Preparative Example 4

The process to prepare Preparative Example 4 is similar to that of Preparative Example 2. However, for Step A, the flask contains methylamyl phosphate acid (about 154.4 g, about 0.647 mol) and at about 25° C., under a nitrogen atmosphere, 1,2-epoxyhexadecane (about 163.0 g, about 0.679 mol) is added dropwise via an addition funnel over a period of about 1.5 hours. The mixture is then heated to about 75° C. and held there for about 4 hours. The product has a phosphorus content of about 6.7 wt %. The product of Step A is then heated to about 60° C., under a nitrogen atmosphere and phosphorus pentoxide (about 33 g, about 0.23 mol) is added in two portions over a period of about 1.5 hours. The temperature was held at about 75° C. for about 1.5 hours. The product is then heated to about 40° C. under nitrogen and bis-(2-ethylhexyl) amine (about 144.8 g, about 0.596 mol) was added dropwise via addition funnel over 1.5 hours. The temperature is then increased to about 70° C. and held for a period of about 2 hours. The product has a phosphorus content of about 6.6 wt %, and a nitrogen content of about 2.1 wt %.

Preparative Example 5 with Thiophosphoric Acid

Phosphorus pentoxide (144 grams) is added in two portions one hour apart to 1176 grams of hydroxypropyl O,O-di (4-methyl-2-pentyl)phosphorodithioate (prepared by reacting di(4-methyl-2-pentyl)-phosphorodithioic acid with about 1.1 moles of propylene oxide at 54° C. and removing excess propylene oxide by vacuum stripping). The mixture is heated at 71° C. for 6 hours to give an acidic intermediate (1320 g). This intermediate is neutralised by adding 555 g of a $C_{12-14}$-alkyl amine over two hours at 49° C. After heating to 77° C. the material is vacuum stripped to give the product.

Preparative Examples 6 to 8 are prepared in a similar manner to Preparative Examples 2 to 4, except the bis-(2-ethylhexyl)amine is replaced with $C_{12-14}$ tertiary alkyl primary amine (Primene® 81R).

In one embodiment the amine or metal salt of a phosphorus compound is an amine salt of a sulphur-containing phosphoric acid as described in U.S. Pat. No. 3,197,405, for example, any one of examples 1 to 25.

In one embodiment amine or metal salt of a phosphorus compound is a sulphur-containing compound.

In one embodiment amine or metal salt of a phosphorus compound is other than a sulphur-containing compound.

The amine salt of a sulphur-free phosphorus compound may be a reaction product prepared from a dithiophosphoric acid reacting with an epoxide or a glycol. This reaction product may be further reacted with a phosphorus acid, anhydride, or lower ester (where "lower" signifies 1 to 8, or 1 to 6, or 1 to 4, or 1 to 2 carbon atoms in the alcohol-derived portion of the ester). The epoxide includes an aliphatic epoxide or a styrene oxide. Examples of useful epoxides include ethylene oxide, propylene oxide, butene oxide, octene oxide, dodecene oxide, styrene oxide and the like. In one embodiment the epoxide may be propylene oxide. The glycols include aliphatic glycols having 1 to 12, or 2 to 6, or 2 to 3 carbon atoms. The resulting acids are then salted with amines.

The amine or metal salt of a phosphorus compound may be present at 0.01 wt % to 10 wt %, or 0.1 wt % to 5 wt %, or 0.2 wt % to 3 wt % of the lubricating composition.

In one embodiment the antiwear package further comprises antiwear agents other than those disclosed above.

In one embodiment the antiwear package does not contain a zinc dialkyldithiophosphate.

In one embodiment the antiwear package does not contain antiwear agents other than those disclosed above.

Other antiwear agents include a non-ionic phosphorus compound with phosphorus atoms having an oxidation state of +3, a metal dialkyldithiophosphate, metal dialkylphosphate (typically a zinc di dialkylphosphate), a metal dialkyldithiophosphate (typically a zinc di dialkyldithiophosphate), or mixtures thereof.

Examples of a suitable zinc dialkyldithiophosphate often referred to as ZDDP, ZDP or ZDTP) include zinc di-(2-methylpropyl) dithiophosphate/di-(amyl) dithiophosphate, zinc di-(1,3-dimethylbutyl) dithiophosphate, zinc di-(heptyl) dithiophosphate, zinc di-(octyl) dithiophosphate, zinc di-(2-ethylhexyl) dithiophosphate, zinc di-(nonyl) dithiophosphate, zinc di-(decyl) dithiophosphate, zinc di-(dodecyl) dithiophosphate, zinc di-(dodecylphenyl) dithiophosphate, zinc di-(heptylphenyl) dithiophosphate, or mixtures thereof.

Examples of a zinc dialkylphosphate include zinc di-(2-methylpropyl) phosphate, zinc di-(amyl) phosphate, zinc di-(1,3-dimethylbutyl) phosphate, zinc di-(heptyl) phosphate, zinc di-(octyl) phosphate, zinc di-(2-ethylhexyl) phosphate, zinc di-(nonyl) phosphate, zinc di-(decyl) phosphate, zinc di-(dodecyl) phosphate, zinc di-(dodecylphenyl) phosphate, zinc di-(heptylphenyl) phosphate, or mixtures thereof.

Examples of a non-ionic phosphorus compound with phosphorus atoms having an oxidation state of +3 include a phosphite ester, or mixtures thereof. A more detailed description of the non-ionic phosphorus compound include column 9, line 48 to column 11, line 8 of U.S. Pat. No. 6,103,673

Organo-Sulphide

In one embodiment the lubricating composition further comprises an organo-sulphide, or mixtures thereof. In one embodiment the organo-sulphide comprises at least one of a polysulphide, thiadiazole compound, or mixtures thereof.

In different embodiments, the organo-sulphide may be present in a range of 0 wt % to 10 wt %, or 0.01 wt % to 10 wt %, or 0.1 wt % to 8 wt %, or 0.25 wt % to 6 wt % of the lubricating composition.

Thiadiazole Compound

Examples of a thiadiazole include 2,5-dimercapto-1,3,4-thiadiazole, or oligomers thereof, a hydrocarbyl-substituted 2,5-dimercapto-1,3-4-thiadiazole, a hydrocarbylthio-substituted 2,5-dimercapto-1,3-4-thiadiazole, or oligomers thereof. The oligomers of hydrocarbyl-substituted 2,5-dimercapto-1,3-4-thiadiazole typically form by forming a sulphur-sulphur bond between 2,5-dimercapto-1,3-4-thiadiazole units to form oligomers of two or more of said thiadiazole units.

Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadaizole. Typically readily available materials such as 2,5-dimercapto-1,3,4-thiadiazole or a hydrocarbyl-substituted 2,5-dimercapto-1,3-4-thiadiazole or a hydrocarbylthio-substituted 2,5-dimercapto-1,3,4-thiadiazole may be commonly utilised, with 2,5-dimercapto-[1,3,4]-thiadiazole most commonly utilised due to availability. In different embodiments the number of carbon atoms on the hydrocarbyl-substituent group includes 1 to 30, 2 to 25, 4 to 20, 6 to 16, or 8 to 10.

In one embodiment, the thiadiazole compound may be the reaction product of a phenol with an aldehyde and a dimercaptothiadiazole. The phenol includes an alkyl phenol wherein the alkyl group contains at least 6, e.g., 6 to 24, or 6 (or 7) to 12 carbon atoms. The aldehyde includes an aldehyde containing 1 to 7 carbon atoms or an aldehyde synthon, such as formaldehyde. Useful thiadiazole compounds include 2-alkyldithio-5-mercapto-[1,3,4]-thiadiazoles, 2,5-bis(alkyldithio)-[1,3,4]-thiadiazoles, 2-alkylhydroxyphenylmethylthio-5-mercapto-[1,3,4]-thiadiazoles (such as 2-[5-heptyl-2-hydroxyphenylmethylthio]-5-mercapto-[1,3,4]-thiadiazole), and mixtures thereof.

In one embodiment the thiadiazole compound includes at least one of 2,5-bis(tert-octyldithio)-1,3,4-thiadiazole, 2,5-bis(tert-nonyldithio)-1,3,4-thiadiazole, or 2,5-bis(tert-decyldithio)-1,3,4-thiadiazole.

Polysulphide

In one embodiment at least 50 wt % of the polysulphide molecules may be a mixture of tri- or tetra-sulphides. In other embodiments at least 55 wt %, or at least 60 wt % of the polysulphide molecules may be a mixture of tri- or tetra-sulphides.

The polysulphide includes a sulphurised organic polysulphide from oils, fatty acids or ester, olefins or polyolefins.

Oils which may be sulfurized include natural or synthetic oils such as mineral oils, lard oil, carboxylate esters derived from aliphatic alcohols and fatty acids or aliphatic carboxylic acids (e.g., myristyl oleate and oleyl oleate), and synthetic unsaturated esters or glycerides.

Fatty acids include those that contain 8 to 30, or 12 to 24 carbon atoms. Examples of fatty acids include oleic, linoleic, linolenic, and tall oil. Sulphurised fatty acid esters prepared from mixed unsaturated fatty acid esters such as are obtained from animal fats and vegetable oils, including tall oil, linseed oil, soybean oil, rapeseed oil, and fish oil.

The polysulphide includes olefins derived from a wide range of alkenes. The alkenes typically have one or more double bonds. The olefins in one embodiment contain 3 to 30 carbon atoms. In other embodiments, olefins contain 3 to 16, or 3 to 9 carbon atoms. In one embodiment the sulphurised olefin includes an olefin derived from propylene, isobutylene, pentene or mixtures thereof.

In one embodiment the polysulphide comprises a polyolefin derived from polymerising by known techniques, an olefin as described above.

In one embodiment the polysulphide includes dibutyl tetrasulphide, sulphurised methyl ester of oleic acid, sulphurised alkylphenol, sulphurised dipentene, sulphurised dicyclopentadiene, sulphurised terpene, and sulphurised Diels-Alder adducts; phosphosulphurised hydrocarbons.

Friction Modifier

In one embodiment the lubricating composition further comprises a friction modifier. In different embodiments, the friction modifier may be present at 0 wt % to 5 wt %, or 0.1 wt % to 4 wt %, or 0.25 wt % to 3.5 wt %, or 0.5 wt % to 2.5 wt %, or 1 wt % to 2.5 wt %, or 0.05 wt % to 0.5 wt % of the lubricating composition.

The friction modifier includes fatty amines, borated glycerol esters, fatty acid amides, non-borated fatty epoxides, borated fatty epoxides, alkoxylated fatty amines, borated alkoxylated fatty amines, metal salts of fatty acids, fatty imidazolines, metal salts of alkyl salicylates (may also be referred to as a detergent), metal salts of sulphonates (may also be referred to as a detergent), condensation products of carboxylic acids or polyalkylene-polyamines, or amides of hydroxyalkyl compounds.

In one embodiment the friction modifer is another type of fatty acid derivative. In one embodiment the friction modifier includes a fatty acid ester or partial ester of glycerol. Such a friction modifier may be in the form of a metal salt, an amide, an imidazoline, or mixtures thereof. The fatty acids may contain 6 to 24, or 8 to 18 carbon atoms. The fatty acids may be branched or straight-chain, saturated or unsaturated. Suitable acids include 2-ethylhexanoic, decanoic, oleic, stearic, isostearic, palmitic, myristic, palmitoleic, linoleic, lauric, and linolenic acids, and the acids from the natural products tallow, palm oil, olive oil, peanut oil, corn oil, and Neat's foot oil. In one embodiment the fatty acid may be oleic acid. When in the form of a metal salt, typically the metal includes zinc or calcium; and the products include overbased and non-overbased products. Examples may be overbased calcium salts and basic oleic acid-zinc salt complexes. When in the form of an amide, the condensation product includes those prepared with ammonia, or with primary or secondary amines such as diethylamine and diethanolamine. When in the form of an imidazoline, the condensation product of an acid with a diamine or polyamine such as a polyethylenepolyamine. In one embodiment the friction modifier may be the condensation product of a fatty acid with $C_8$ to $C_{24}$ atoms, and a polyalkylene polyamine, and in particular, the product of isostearic acid with tetraethylenepentamine.

In one embodiment the friction modifier includes a secondary or tertiary amine being represented by the formula $R^aR^b$-$NR^c$, wherein $R^a$ and $R^b$ are each independently an alkyl group of at least 6 carbon atoms and $R^c$ is hydrogen, a hydrocarbyl group, a hydroxyl-containing alkyl group, or an amine-containing alkyl group. A more detailed description of the friction modifier is described in US Patent Application 2005/037897 in paragraphs 8 and 19 to 22.

In one embodiment the friction modifier includes those formed by the condensation of the hydroxyalkyl compound with an acylating agent or an amine. A more detailed description of the hydroxyalkyl compound is described in U.S. Patent Application 60/725,360 (filed on Oct. 11, 2005, inventors Bartley, Lahiri, Baker and Tipton) in paragraphs 8, and 19-21. The friction modifier disclosed in U.S. Patent Application 60/725,360 includes an amide represented by the formula $R^dR^dN$—C(O)$R^f$, wherein $R^d$ and $R^e$ are each independently hydrocarbyl groups of at least 6 carbon atoms and $R^f$ is a hydroxyalkyl group of 1 to 6 carbon atoms or a group formed by the condensation of said hydroxyalkyl group, through a hydroxyl group thereof, with an acylating agent. Preparative Examples are disclosed in Examples 1 and 2 (paragraphs 68 and 69 of U.S. Patent Application 60/725,360). In one embodiment the amide of a hydroxylalkyl compound is prepared by reacting glycolic acid, that is, hydroxyacetic acid, HO—$CH_2$—COOH with an amine.

In one embodiment the friction modifier includes a reaction product of a di-cocoalkyl amine (or di-cocoamine) with glycolic acid. The friction modifier includes compounds prepared in Preparative Examples 1 and 2 of U.S. Patent Application 60/820,516.

In one embodiment the friction modifier includes those derived from the reaction product of a carboxylic acid or a reactive equivalent thereof with an aminoalcohol, wherein the friction modifier contains at least two hydrocarbyl groups, each containing at least 6 carbon atoms. An example of such a friction modifier includes the reaction product of isostearic acid or an alkyl succinic anhydride with tris-hydroxymethylaminomethane. A more detailed description of such a friction modifier is disclosed in US Patent Application 2003/22000 (or International Publication WO04/007652) in paragraphs 8 and 9 to 14.

In one embodiment the friction modifier includes an alkoxylated alcohol. A detailed description of suitable alkoxylated alcohols is described in paragraphs 19 and 20 of US Patent Application 2005/0101497. The alkoxylated amines are also described in U.S. Pat. No. 5,641,732 in column 7, line 15 to column 9, line 25.

In one embodiment the friction modifier includes a hydroxylamine compound as defined in column 37, line 19, to column 39, line 38 of U.S. Pat. No. 5,534,170. Optionally the hydroxylamine includes borated as such products are described in column 39, line 39 to column 40 line 8 of U.S. Pat. No. 5,534,170.

In one embodiment the friction modifier includes an alkoxylated amine e.g., an ethoxylated amine derived from 1.8% Ethomeen T-12 and 0.90% Tomah PA-1 as described in Example E of U.S. Pat. No. 5,703,023, column 28, lines 30 to 46. Other suitable alkoxylated amine compounds include commercial alkoxylated fatty amines known by the trademark "ETHOMEEN" and available from Akzo Nobel. Representative examples of these ETHOMEEN™ materials is ETHOMEEN™ C/12 (bis[2-hydroxyethyl]-cocoamine); ETHOMEEN™ C/20 (polyoxyethylene[10]cocoamine); ETHOMEEN™ S/12 (bis[2-hydroxyethyl]soyamine); ETHOMEEN™ T/12 (bis[2-hydroxyethyl]-tallow-amine); ETHOMEEN™ T/15 (polyoxyethylene-[5]tallowamine); ETHOMEEN™ 0/12 (bis[2-hydroxyethyl]oleyl-amine); ETHOMEEN™ 18/12 (bis[2-hydroxyethyl]octadecylamine); and ETHOMEEN™ 18/25 (polyoxyethylene[15] octadecylamine). Fatty amines and ethoxylated fatty amines are also described in U.S. Pat. No. 4,741,848.

In one embodiment the friction modifier includes a polyol ester as described in U.S. Pat. No. 5,750,476 column 8, line 40 to column 9, line 28.

In one embodiment the friction modifier includes a low potency friction modifier as described in U.S. Pat. No. 5,840,662 in column 2, line 28 to column 3, line 26. U.S. Pat. No. 5,840,662 further discloses in column 3, line 48 to column 6, line 25 specific materials and methods of preparing the low potency friction modifier.

In one embodiment the friction modifier includes a reaction product of an isomerised alkenyl substituted succinic anhydride and a polyamine as described in U.S. Pat. No. 5,840,663 in column 2, lines 18 to 43. Specific embodiments of the friction modifier described in U.S. Pat. No. 5,840,663 are further disclosed in column 3, line 23 to column 4, line 35. Preparative examples are further disclosed in column 4, line 45 to column 5, line 37 of U.S. Pat. No. 5,840,663.

In one embodiment the friction modifier includes an alkylphosphonate mono- or di-ester sold commercially by Rhodia under the trademark Duraphos® DMODP.

In one embodiment the friction modifier includes a borated fatty epoxide or alkylene oxide, known from Canadian Patent No. 1,188,704. These oil-soluble boron-containing compositions may be prepared by reacting, at a temperature of 80° C. to 250° C., boric acid or boron trioxide with at least one fatty epoxide or alkylene oxide. The fatty epoxide or alkylene oxide typically contains at least 8 carbon atoms in the fatty groups of the epoxide (or the alkylene groups of the alkylene oxide).

The borated fatty epoxides include those characterised by the method for their preparation which involves the reaction of two materials. Reagent A includes boron trioxide or any of the various forms of boric acid including metaboric acid ($HBO_2$), orthoboric acid ($H_3BO_3$) and tetraboric acid ($H_2B_40_7$), or orthoboric acid. Reagent B includes at least one fatty epoxide. The molar ratio of reagent A to reagent B may be generally 1:0.25 to 1:4, or 1:1 to 1:3, or 1:2. The borated fatty epoxides includes compounds prepared by blending the two reagents and heating them at temperature of 80° C. to 250° C., or 100° C. to 200° C., for a period of time sufficient for reaction to take place. If desired, the reaction may be effected in the presence of a substantially inert, normally liquid organic diluent. During the reaction, water is evolved and may be removed by distillation.

Oils of Lubricating Viscosity

The lubricating oil composition includes natural or synthetic oils of lubricating viscosity, oil derived from hydrocracking, hydrogenation, hydrofinishing, and unrefined, refined and re-refined oils and mixtures thereof.

Natural oils include animal oils, vegetable oils, mineral oils and mixtures thereof. Synthetic oils include hydrocarbon oils, silicon-based oils, and liquid esters of phosphorus-containing acids. Synthetic oils may be produced by Fischer-Tropsch gas-to-liquid synthetic procedure as well as other gas-to-liquid oils. In one embodiment the composition of the present invention is useful when employed in a gas-to-liquid oil. Often Fischer-Tropsch hydrocarbons or waxes may be hydroisomerised.

In one embodiment the base oil comprises a polyalphaolefin including a PAO-2, PAO-4, PAO-5, PAO-6, PAO-7 or PAO-8. The polyalphaolefin in one embodiment is prepared from dodecene and in another embodiment from decene.

In one embodiment the oil of lubricating viscosity is an ester such as an adipate.

In one embodiment the oil of lubricating viscosity is at least in-part a polymer (may also be referred to as a viscosity modifier) including hydrogenated copolymers of styrene-butadiene, ethylene-propylene copolymers, polyisobutenes, hydrogenated styrene-isoprene polymers, hydrogenated isoprene polymers, polymethacrylates, polyacrylates, polyalkyl styrenes, alkenyl aryl conjugated diene copolymers, polyolefins, esters of maleic anhydride-styrene copolymers, esters of maleic anhydride-olefin copolymers, and mixtures thereof. In different embodiments the polymer includes polyacrylates, polymethacrylates, and esters of maleic anhydride-styrene copolymers, polyisobutenes or mixtures thereof.

In one embodiment the lubricating composition contains an oil of lubricating viscosity containing mixtures of a viscosity modifier and an API Group III or IV base oil. In one embodiment the lubricating composition contains a synthetic oil of lubricating viscosity.

Oils of lubricating viscosity may also be defined as specified in the American Petroleum Institute (API) Base Oil Interchangeability Guidelines. In one embodiment the oil of lubricating viscosity comprises an API Group I, II, III, IV, V, VI base oil, or mixtures thereof, and in another embodiment API Group II, III, IV base oil or mixtures thereof. In another embodiment the oil of lubricating viscosity is a Group III or IV base oil and in another embodiment a Group IV base oil.

The amount of the oil of lubricating viscosity present is typically the balance remaining after subtracting from 100 wt % the sum of the amount of the compounds of the present invention, the friction modifier, the conventional phosphorus antiwear and/or extreme pressure agent, the organo-sulphide, and the other performance additives (described below).

In one embodiment the lubricating composition may be in the form of a concentrate and/or a fully formulated lubricant. If the antiwear package, and the other performance additives may be in the form of a concentrate (which may be combined with additional oil to form, in whole or in part, a finished lubricant), the ratio of the components of the lubricating composition to the oil of lubricating viscosity and/or to diluent oil include the ranges of 1:99 to 99:1 by weight, or 80:20 to 10:90 by weight.

Other Performance Additive

The composition of the invention optionally further includes at least one other performance additive. The other performance additives include metal deactivators, detergents, dispersants, viscosity modifiers, dispersant viscosity modifiers, antioxidants, corrosion inhibitors, foam inhibitors, demulsifiers, pour point depressants, seal swelling agents, and mixtures thereof.

In different embodiments, the total combined amount of the other performance additive compounds may be present at 0 wt % to 25 wt %, or 0.1 wt % to 15 wt %, or 0.5 wt % to 10 wt % of the lubricating composition. Although one or more of the other performance additives may be present, it is common for the other performance additives to be present in different amounts relative to each other.

Antioxidants include molybdenum compounds such as molybdenum dithiocarbamates, sulphurised olefins, hindered phenols, aminic compounds such as alkylated diphenylamines (typically di-nonyl diphenylamine, octyl diphenylamine, or di-octyl diphenylamine), or mixtures thereof.

Detergents include neutral or overbased detergents, Newtonian or non-Newtonian, basic salts of alkali, alkaline earth or transition metals with one or more of a phenate, a sulphurised phenate, a sulphonate, a carboxylic acid, a phosphorus acid, a mono- and/or a di-thiophosphoric acid, a saligenin, an alkylsalicylate, and a salixarate mixtures.

Dispersants include N-substituted long chain alkenyl succinimides, as well as Mannich condensation products as well as post-treated versions thereof. Post-treated dispersants include those by reaction with urea, thiourea, dimercaptothiadiazoles, carbon disulphide, aldehydes, ketones, carboxylic acids, hydrocarbon-substituted succinic anhydrides, nitriles, epoxides, boron compounds, and phosphorus compounds, mixtures.

In one embodiment the dispersant is a borated dispersant, typically a borated polyisobutylene succinimide. Typically the number average molecular weight of the polyisobutylene ranges from 450 to 5000, or 550 to 2500. The borated dispersant may also have friction performance.

In different embodiments, the dispersant may present at 0 wt % to 10 wt %, or 0.01 wt % to 10 wt %, or 0.1 wt % to 5 wt %, of the lubricating composition.

Viscosity modifiers include hydrogenated copolymers of styrene-butadiene, ethylene-propylene copolymers, polyisobutenes, hydrogenated styrene-isoprene polymers, hydrogenated isoprene polymers, polymethacrylates, polyacrylates, polyalkyl styrenes, hydrogenated alkenyl aryl conjugated diene copolymers, polyolefins, esters of maleic anhydride-styrene copolymers, esters of maleic anhydride-olefin copolymers, or mixtures thereof.

In one embodiment the viscosity modifier is other than olefin copolymers, typically ethylene-propylene copolymers.

In one embodiment the viscosity modifier includes polyisobutenes, polymethacrylates, polyacrylates, esters of maleic anhydride-styrene copolymers, esters of maleic anhydride-olefin copolymers, or mixtures thereof.

In one embodiment the viscosity modifier includes polymethacrylates.

In different embodiments, the viscosity modifier may be present at 0 wt % to 70 wt %, or 1 wt % to 65 wt %, or 5 wt % to 60 wt %, or greater than 12 wt % to 55 wt % of the lubricating composition.

If viscosity modifiers with a low number average molecular weight (i.e., 20,000 or less) are employed, higher treatment rates are typically required. In some instances the treat rate may be sufficiently high that the viscosity modifier becomes a significant replacement for base oil (or the oil of lubricating viscosity). As such the viscosity modifiers may be viewed as a synthetic base stock, or as a component of the base oil.

Dispersant viscosity modifiers (often referred to as DVM) include functionalised polyolefins, for example, ethylene-propylene copolymers that have been functionalized with the reaction product of maleic anhydride and an amine, a polymethacrylate functionalised with an amine, or styrene-maleic anhydride copolymers reacted with an amine; these may also be used in the composition of the invention.

Corrosion inhibitors include octylamine octanoate, condensation products of dodecenyl succinic acid or anhydride and a fatty acid such as oleic acid with a polyamine, or a thiadiazole compound described above. Metal deactivators include derivatives of benzotriazoles (typically tolyltriazole), 1,2,4-triazoles, 2-alkyldithiobenzimidazoles, 2-alkyldithiobenzothiazoles, or benzimidazoles.

Foam inhibitors include copolymers of ethyl acrylate and 2-ethylhexylacrylate and optionally vinyl acetate. Demulsifiers include trialkyl phosphates, polyethylene glycols, polyethylene oxides, polypropylene oxides and (ethylene oxide-propylene oxide) polymers. Pour point depressants include esters of maleic anhydride-styrene, polymethacrylates, polyacrylates or polyacrylamides. Seal swell agents include Exxon Necton-37™ (FN 1380) and Exxon Mineral Seal Oil (FN 3200).

INDUSTRIAL APPLICATION

The method of the invention may be useful for lubricating a variety of driveline devices. The driveline device comprises at least one of a gear, a gearbox, an axle gear, a traction drive transmission, an automatic transmission or a manual transmission. In one embodiment the driveline device may be a manual transmission or a gear, a gearbox, or an axle gear.

The automatic transmission includes continuously variable transmissions (CVT), infinitely variable transmissions (IVT), Toroidal transmissions, continuously slipping torque converted clutches (CSTCC), stepped automatic transmissions or dual clutch transmissions (DCT).

The following examples provide illustrations of the invention. These examples are non-exhaustive and are not intended to limit the scope of the invention.

EXAMPLES

Gear Oil Lubricants (CE1 to CE3 and EX1 to EX2)

A series of gear oil lubricants are prepared containing a blend of base oils (40 wt % Yubase 4, 40 wt % polyalphaolefin, 10 wt % 2-ethylhexyl adipate), and a gear oil concentrate. The gear oil concentrate once blended comprises 1.2 wt % of borated dispersant (including conventional amounts of diluent), 0.1 wt % of 2,5-bis(tert-nonyldithio)-1,3,4-thiadiazole, and 3 wt % of sulphurised olefin. In addition the gear oil lubricants contain components as summarised in the following below.

| | Amount of THP (wt %) | Amount of HP (wt %) | Isotridecyl Tartrate (wt %) | Phosphorus Content (ppm) |
|---|---|---|---|---|
| CE1 | 0.59 | 0 | 0 | 500 |
| CE2 | 0 | 0.63 | 0 | 500 |
| EX1 | 0.59 | 0 | 1 | 500 |
| EX2 | | 0.63 | 1 | 500 |
| CE3 | 0 | 0 | 1 | 0 |

Footnote:

THP is the product of Preparative Example 5.

HP is a Phosphoric Acid product from one of the Preparative Examples 1 to 4, or Preparative Examples 6 to 8 (see preparative examples above).

The gear oils are tested for performance at high speed, low torque, followed by low speed, high torque. The methodology is the same as ASTM D6121. The results obtained are:

| | | Types of Distress Measured on Ring and Pinion | | | | |
|---|---|---|---|---|---|---|
| | | Wear | Rippling | Ridging | Pitting/Spalling | Scoring |
| CE1 | Ring | 7 | 8 | 5 | 9.9 | 10 |
| | Pinion | 5 | 9 | 5 | 9.4 | 10 |
| CE2 | Ring | 7 | 10 | 5 | 9.9 | 10 |
| | Pinion | 6 | 9 | 5 | 9.7 | 10 |
| EX1 | Ring | 7 | 10 | 9 | 9.9 | 10 |
| | Pinion | 7 | 9 | 9 | 9.9 | 10 |
| EX2 | Ring | 7 | 10 | 10 | 9.9 | 10 |
| | Pinion | 7 | 8 | 9 | 9.9 | 10 |
| CE3 | Ring | 6 | 10 | 5 | 9.7 | 10 |
| | Pinion | 5 | 10 | 4 | 4 | 10 |

Overall the results indicate that the lubricating composition of the invention is capable of providing a gear oil with acceptable levels of wear performance, particularly for ridging protection for both ring and pinion. In addition, the lubricating composition of the invention is capable of providing a gear oil with acceptable levels of wear protection whilst maintaining protection against rippling and pitting/spalling.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. The amount of each chemical component is presented inclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulphoxy);

(iii) hetero substituents, that is, substituents which, while having a predominantly hydrocarbon character, in the context of this invention, contain other than carbon in a ring or chain otherwise composed of carbon atoms; and (iv) heteroatoms include sulphur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method for lubricating a driveline device comprising supplying to the driveline device a lubricating composition comprising an oil of lubricating viscosity and 0.05 wt % to 5 wt % of an antiwear package, wherein the antiwear package comprises:

(a) 0.25 to 1 wt % of a derivative of C11 to C18 ester or imide derivative of tartaric acid, (b) 0.05 to 2.5 wt % of a phosphorus compound, wherein the phosphorus compound is an amine of a phosphorus compound that is either:

(i) a hydroxy-substituted di-ester of (thio)phosphoric acid, or (ii) a phosphorylated hydroxy-substituted di- or tri-ester of (thio)phosphoric acid;

(c) 0.25 wt % to 3.1 wt % of an organo-sulphide comprising at least one of a polysulphide, thiadiazole compound, or mixtures thereof; and wherein the lubricating composition has a sulphur-content of 0.8 wt % to 2.5 wt % of the lubricating composition.

2. The method of claim 1, wherein the driveline device is a manual transmission or a gear, a gearbox, an axle gear, or an automatic transmission.

3. The method of claim 1, wherein the lubricating composition further comprises a viscosity modifier selected from the group consisting of polyisobutenes, polymethacrylates, polyacrylates, esters of maleic anhydride-styrene copolymers, esters of maleic anhydride-olefin copolymers, and mixtures thereof.

4. The method of claim 3, wherein the viscosity modifier is a polymethacrylate.

5. The method of claim 3, wherein the viscosity modifier is present at greater than 12 wt % to 55 wt %, of the lubricating composition.

6. The method of claim 1, wherein the amine salt of the phosphorus compound is sulphur-free, and wherein the sulphur-free amine salt of the phosphorus compound is either:

(i) a hydroxy-substituted di-ester of phosphoric acid, or (ii) a phosphorylated hydroxy-substituted di- or tri-ester of phosphoric acid.

7. The method of claim 6, wherein the sulphur-free amine salt of the phosphorus compound is represented by Formula (2a):

Formula (2a)

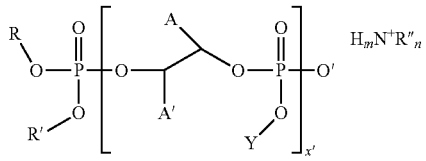

wherein

A and A' are independently H, or a hydrocarbyl group containing 1 to 30 carbon atoms;

each R and R" group are independently a hydrocarbyl group;

each R' is independently R, H, or a hydroxyalkyl group;

Y is independently R', or a group represented by RO(R'O)P(O)—CH(A')CH(A)- (such as RO(R'O)P(O)—$CH_2CH(CH_3)$—);

x' ranges from 0 to 1 (in one embodiment when x'=0, R' is a hydroxyalkyl group);

m and n are both positive non-zero integers, with the proviso that the sum of (m+n) is equal to 4.

8. The method of claim 1, wherein the lubricating composition has a sulphur-content of 1 wt % to 2 wt %.

9. The method of claim 1, wherein the derivative is an ester of tartaric acid.

10. The method of claim 1, wherein the lubricating composition has a sulphur-content of 1 wt % to 2 wt %.

* * * * *